US011549734B2

(12) United States Patent
Izadi-Zamanabadi et al.

(10) Patent No.: US 11,549,734 B2
(45) Date of Patent: Jan. 10, 2023

(54) METHOD FOR TERMINATING DEFROSTING OF AN EVAPORATOR BY USE OF AIR TEMPERATURE MEASUREMENTS

(71) Applicant: Danfoss A/S, Nordborg (DK)

(72) Inventors: Roozbeh Izadi-Zamanabadi, Nordborg (DK); Carsten Mølhede Thomsen, Nordborg (DK)

(73) Assignee: Danfoss A/S, Nordborg (DK)

( * ) Notice: Subject to any disclaimer, the term of this patent is extended or adjusted under 35 U.S.C. 154(b) by 57 days.

(21) Appl. No.: 17/044,151

(22) PCT Filed: Jun. 21, 2019

(86) PCT No.: PCT/EP2019/066443
§ 371 (c)(1),
(2) Date: Sep. 30, 2020

(87) PCT Pub. No.: WO2019/243561
PCT Pub. Date: Dec. 26, 2019

(65) Prior Publication Data

US 2021/0156600 A1 May 27, 2021

(30) Foreign Application Priority Data

Jun. 22, 2018 (EP) ..... 18179425

(51) Int. Cl.
*F25B 13/00* (2006.01)
*F25B 47/02* (2006.01)
(Continued)

(52) U.S. Cl.
CPC ..... *F25B 47/025* (2013.01); *F25B 13/00* (2013.01); *F25B 39/00* (2013.01); *F25B 49/02* (2013.01);
(Continued)

(58) Field of Classification Search
CPC ..... F25B 47/025; F25B 13/00; F25B 39/00; F25B 49/02; F25B 47/02; F25B 2700/21174; F25B 2700/21175
See application file for complete search history.

(56) References Cited

U.S. PATENT DOCUMENTS 2,743,587 A 5/1956 Hubacker
4,262,496 A 4/1981 Bell, Jr.
(Continued)

FOREIGN PATENT DOCUMENTS

CN 101743449 A 6/2010
CN 108106283 A 6/2018
(Continued)

OTHER PUBLICATIONS

Lukasse, Method for reducing ice formation in a cooling unit, 2016, Full Document (Year: 2016).*
(Continued)

*Primary Examiner* — Nael N Babaa
(74) *Attorney, Agent, or Firm* — McCormick, Paulding & Huber PLLC

(57) ABSTRACT

A method for terminating defrosting of an evaporator (104) is disclosed. The evaporator (104) is part of a vapour compression system (100). The vapour compression system (100) further comprises a compressor unit (101), a heat rejecting heat exchanger (102), and an expansion device (103). The compressor unit (101), the heat rejecting heat exchanger (102), the expansion device (103) and the evaporator (104) are arranged in a refrigerant path, and an air flow is flowing across the evaporator (104). When ice is accumulated on the evaporator (104), the vapour compression system (100) operates in a defrosting mode. At least one temperature sensor (305) monitors a temperature $T_{air}$, of air leaving the evaporator (104). A rate of change of $T_{air}$ is
(Continued)

monitored and defrosting is terminated when the rate of change of the temperature, $T_{air}$, approaches zero.

20 Claims, 6 Drawing Sheets

(51) Int. Cl.
*F25B 39/00* (2006.01)
*F25B 49/02* (2006.01)

(52) U.S. Cl.
CPC . *F25B 2347/02* (2013.01); *F25B 2700/21174* (2013.01); *F25B 2700/21175* (2013.01)

(56) References Cited

U.S. PATENT DOCUMENTS

| | | | |
|---|---|---|---|
| 5,201,185 | A | 4/1993 | Hanson et al. |
| 5,261,246 | A | 11/1993 | Blackmon et al. |
| 7,685,830 | B2 | 3/2010 | Thybo et al. |
| 9,410,727 | B1 | 8/2016 | Boyko |
| 10,488,088 | B2 | 11/2019 | Verma et al. |
| 2009/0320504 | A1 | 12/2009 | Gupte |
| 2010/0199707 | A1 | 8/2010 | Pearson |
| 2012/0042667 | A1 | 2/2012 | Fulmer et al. |
| 2013/0086929 | A1 | 4/2013 | Senf, Jr. |
| 2015/0204589 | A1 | 7/2015 | Liu |
| 2015/0267930 | A1 | 9/2015 | Ryu et al. |
| 2021/0033325 | A1 | 2/2021 | Izadi-Zamanabadi et al. |

FOREIGN PATENT DOCUMENTS

| | | | | |
|---|---|---|---|---|
| EP | 0115799 | A1 | 8/1984 | |
| EP | 0256602 | A1 | 2/1988 | |
| EP | 0345098 | A2 | 12/1989 | |
| EP | 3315838 | A1 | 5/2018 | |
| EP | 3591316 | A1 | 1/2020 | |
| EP | 3660418 | A1 | 6/2020 | |
| EP | 3660419 | A1 | 6/2020 | |
| EP | 3660494 | A1 | 6/2020 | |
| GB | 694763 | A | 7/1953 | |
| JP | 2005226972 | A | 8/2005 | |
| KR | 20160118748 | A | 10/2016 | |
| WO | 2010107536 | A2 | 9/2010 | |
| WO | 2013082401 | A1 | 6/2013 | |
| WO | 2016000750 | A1 | 1/2016 | |
| WO | WO-2016000750 | A1 * | 1/2016 | ..... F25D 21/008 |
| WO | 2020169220 | A1 | 8/2020 | |

OTHER PUBLICATIONS

Bruce I. Nelson, "Optimizing Evaporator Runtime and Defrost Frequency," International Institute of Ammonia, Technical Papers Refrigeration, 37th Annual Meeting, Mar. 2015.

Bruce I. Nelson, "Optimizing Hot Gas Defrost," Colmac Coil, Technical Bulletin, 2012.

D. A. Ali et al., "The Effects of Frost Formation on the Performance of Domestic Refrigerator-Freezer Finned-Tube Evaporator Coils," Department of Mechanical and Industrial Engineering University of illinois at Urbana-Champaign, Feb. 1992.

D. M. Admiraal et al., "Heat Transfer in Refrigerator Condensers and Evaporators," Air Conditioning and Refrigeration Center, University of Illinois, Mechanical & Industrial Engineering Dept., Aug. 1993.

Y. Kim et al., "Heat and Mass Transfer Coefficients Under Frost Conditions In A Finned-Tube Evaporator," International Refrigeration and Air Conditioning Conference, School of Mechanical Engineering, 2002.

Kyle A. Manske, "Performance Optimization of Industrial Refrigeration Systems," University of Wisconsin-Madison, 1999.

Nawaf Faisal Aljuwayhel, "Numerical and Experimental Study of the Influence of Frost Formation and Defrosting on the Performance of Industrial Evaporator Coils," University of Wisconsin-Madison, 2006.

Indian First Examination Report for Application No. 202017041515 dated Feb. 3, 2021.

International Search Report For Serial No. PCT/EP2019/065120 dated Jul. 11, 2019.

International Search Report For Serial No. PCT/EP2019/067750 dated Aug. 8, 2019.

International Search Report For Serial No. PCT/EP2019/066443 dated Jul. 30, 2019.

* cited by examiner (a)

(b)

(c)

(a)

(b)

METHOD FOR TERMINATING DEFROSTING OF AN EVAPORATOR BY USE OF AIR TEMPERATURE MEASUREMENTS

CROSS-REFERENCE TO RELATED APPLICATIONS

This application is a National Stage application of International Patent Application No. PCT/EP2019/066443, filed on Jun. 21, 2019, which claims priority to European Patent Application No. 18179425.6 filed on Jun. 22, 2018, each of which is hereby incorporated by reference in its entirety.

TECHNICAL FIELD

The present invention relates to a method for terminating defrosting of an evaporator by monitoring at least one temperature of air leaving the evaporator. Defrosting is terminated when a rate of change of the monitored temperature approaches zero.

BACKGROUND

Vapour compression systems, such as refrigeration systems, heat pumps or air condition systems, are normally controlled in order to provide a required cooling or heating capacity in an as energy efficient manner as possible. In some scenarios, the operation of the vapour compression system may become energy inefficient, and the system may even become unstable or the system may become unable to provide the required cooling or heating capacity. In particular, during operation of a vapour compression system, such as a refrigeration system with a cooled chamber, ice or frost will deposit on the heat transfer surfaces of an evaporator. Namely, condensation of moisture in the cooled chamber leads to ice accumulation over time on the evaporator in the refrigeration system. Ice buildups disturb air circulation inside the system. This leads to a decrease in cooling efficiency and hence negatively impacts the heat transfer performance. Frost and ice buildups must be recognized before the cooling efficiency of the system has been significantly reduced. Once frost and ice has been identified, defrosting will be initiated and ice will start melting. During defrosting, the evaporator is heated in order to melt ice buildups. It is desired that this defrosting mode lasts as short as possible for a number of reasons. One of the reasons is again energy efficiency and energy consumption. Additionally, it is desired that items comprised in the cooled chamber are cooled almost all times. Therefore, in the most optimal case, defrosting should be terminated as soon as all the ice and frost has been melted.

In commercial refrigeration systems, termination of defrosting is typically performed after a predetermined period of time upon defrosting initiation. In one example, this predetermined period of time may not be sufficient for complete defrosting to happen and the system may have remaining ice on the evaporator. In another example, the predetermined period of time may be longer than what is needed for complete defrosting to happen and in such a case, the system is not under optimal conditions for a too long period of time as defrosting consumes excessive energy. In yet another example, the system may be programmed to terminate defrosting when a certain temperature inside the evaporator is achieved. This approach may as well not be the most optimal in terms of complete defrosting of the evaporator as some parts of it may still have remaining ice. Remaining ice influences operation of the system and degrades performances which should be at a high level right upon defrosting. Furthermore, the remaining ice may speed up accumulation of new ice layers.

US 2012/0042667 discloses an apparatus and method for terminating a refrigeration unit's defrost function. The refrigeration unit comprises an evaporator, a temperature sensor to measure the temperature of the evaporator during a defrost function, and a controller configured to calculate the rate of temperature change and terminate the defrost function when the rate meets a specified criteria, such as a predetermined rate or a sharp increase in the rate after the evaporator temperature has increased above the freezing point of water.

SUMMARY

It is an object of embodiments of the invention to provide a method for terminating full defrosting of an evaporator in an energy efficient manner, providing complete defrosting within an optimal period of time.

The invention provides a method for terminating defrosting of an evaporator, the evaporator being part of a vapour compression system, the vapour compression system further comprising a compressor unit, a heat rejecting heat exchanger, and an expansion device, the compressor unit, the heat rejecting heat exchanger, the expansion device and the evaporator being arranged in a refrigerant path, and an air flow flowing across the evaporator, the method comprising the steps of:

- operating the vapour compression system in a defrosting mode,
- monitoring, by at least one temperature sensor, at least one temperature, $T_{air}$, of air leaving the evaporator,
- monitoring a rate of change of the temperature, $T_{air}$, and
- terminating defrosting when the rate of change of the temperature, $T_{air}$, approaches zero.

By monitoring at least one temperature of air leaving the evaporator chances of having ice at the surface of the evaporator are decreased. Further, a temperature of the evaporator may stabilize, i.e. become constant, only when ice is removed from its entire surface and a stable convection will happen only then. When monitoring a rate of change of the at least one temperature of air leaving the evaporator, defrosting can be terminated as soon as all the ice is removed from the evaporator.

The vapour compression system comprises an evaporator, a compressor unit, a heat rejecting heat exchanger and an expansion device. There may be more than one evaporator and more than one expansion device. The compressor unit may comprise one or more compressors. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The evaporator is arranged in the refrigerant path. Evaporation of a liquid part of the refrigerant takes place in the evaporator, while heat exchange takes place between the refrigerant and the ambient or a secondary fluid flow across the evaporator, in such a manner that heat is absorbed by the refrigerant passing through the evaporator.

The compressor unit receives the refrigerant from the evaporator. The refrigerant is then normally in gaseous phase and the compressor unit compresses it and supplies it further to the heat rejecting heat exchanger.

The heat rejecting heat exchanger may, e.g., be in the form of a condenser, in which refrigerant is at least partly condensed, or in the form of a gas cooler, in which refrigerant is cooled, but remains in a gaseous or trans-critical state. The heat rejecting heat exchanger is also arranged in the refrigerant path.

The expansion device may, e.g., be in the form of an expansion valve. The expansion device is arranged in the refrigerant path, supplying refrigerant to the one or more evaporator. In a vapour compression system, such as a refrigeration system, an air condition system, a heat pump, etc., a fluid medium, such as refrigerant, is thereby alternatingly compressed by means of one or more compressors and expanded by means of one or more expansion devices, and heat exchange between the fluid medium and the ambient takes place in one or more heat rejecting heat exchangers, e.g. in the form of condensers or gas coolers, and in one or more heat absorbing heat exchangers, e.g. in the form of evaporators.

According to the invention, the vapour compression system is operating in a defrosting mode. The defrosting mode is initiated to remove any frost or ice buildup on the evaporator. The defrosting mode may be initiated when necessary, i.e., when frost of ice buildup reaches a predetermined level or alternatively according to a predefined schedule. When operating in the defrosting mode, the evaporator is heated, and therefore any frost or ice formed on the evaporator is melted. Heating of the evaporator may be performed by injecting a hot gas into the evaporator through an evaporator inlet. Alternatively, the evaporator may be heated in another manner, such as by means of an electrical heater.

During defrosting, at least one temperature sensor monitors a temperature of air leaving the evaporator. The at least one temperature may be monitored from the beginning of the defrosting mode. Alternatively, monitoring the at least one temperature may start after a certain period of time upon the initiation of the defrosting mode, as in the initial phase of defrosting no ice will be melted, but energy may rather be spent on heating the evaporator itself. Preferably, the at least one temperature may be monitored only after several minutes, once the evaporator and its tubes are heated. When starting the defrosting cycle there may be a large step when the temperature changes over time. Analysis of this step may not be needed. Therefore, a delay in logging the temperature may be useful in order to perform signal processing faster. The at least one temperature may be continuously monitored over time during defrosting. Alternatively, the at least one temperature may be measured intermittently, with a certain frequency. The at least one temperature sensor may be placed in a vicinity of the evaporator, either on its air inlet and/or an air outlet of the evaporator where the transient behaviour of the air temperature can be recorded. In this way, the temperature of air leaving the evaporator is measured. During the temperature measurements the fans of the evaporator may be switched off. The measured temperature may be communicated to a control unit or a processor which controls operation of the entire vapour compression system.

A rate of change of the air temperature, $T_{air}$, is monitored, e.g. by means of the control unit or processor mentioned above. By monitoring the rate of change of the air temperature a dynamic behaviour of the air temperature may be analysed and a steady state condition of the evaporator may be identified. Typically, at the beginning of defrosting, the temperature of air leaving the evaporator may rise quickly. Depending on the amount of frost or ice, a time period required for the temperature, $T_{air}$, to reach a steady state may vary and be as long as 60 minutes. Typically, this time period is between 15 and 30 minutes. Alternatively, variance of the measured temperature, $T_{air}$, may be monitored, e.g., by means of the control unit or processor. In yet another alternative, a mixture of the rate of change and variance may be monitored to identify the steady state of the evaporator.

As frost and ice is melting from the evaporator, the temperature, $T_{air}$, may stabilize and reach a constant value indicating the steady state condition. Small fluctuations of the air temperature may occur originating from noise in the measurements. When the temperature, $T_{air}$, has the constant value, i.e., when it reaches the steady state condition, the rate of change of the temperature will be zero. When the rate of change of $T_{air}$ approaches zero the evaporator operates in a manner which is expected when there is no ice or frost on its surface. Therefore, no change in the temperature, $T_{air}$, indicates that all the ice or frost has been removed and there is no need for further defrosting. The processor may analyse the rate of change of the temperature, $T_{air}$, over time. If the rate of change of $T_{air}$ is zero for a certain period of time, information from the processor may be communicated to another control unit in order to stop defrosting. In this manner, defrosting is terminated as soon as all frost or ice has been removed from all the surfaces of the evaporator.

In one embodiment of the invention, the step of terminating defrosting may be performed when the rate of change of the temperature, $T_{air}$, has been smaller than a predetermined threshold value for a predetermined time. During defrosting and for a short period of time, it may happen that the temperature of air leaving the evaporator has a constant value. The rate of change of the temperature, $T_{air}$, during this short period of time may then be close to zero. This situation may arise, e.g., when the evaporator reaches the freezing point of water, and due to the ice buildups, the temperature, $T_{air}$, may be close to the freezing point of water and keep the same value for a short period of time. To avoid a premature termination of defrosting, the rate of change may be smaller than the predetermined threshold value for a predetermined period of time. The predetermined time may be longer than one minute. The predetermined threshold value may be such as between 0° C./s and 3° C./s, such as between 0° C./s and 2.5° C./s, such as between 0° C./s and 2° C./s, such as between 0° C./s and 1.5° C./s, and such as between 0° C./s and 1° C./s, and such as approximately 1° C./s, such as approximately 1.5° C./s, such as approximately 2° C./s, such as approximately 2.5° C./s, and such as approximately 3° C./s. Alternatively, the predetermined threshold value may be determined during the measurements as the dynamic behaviour of the air temperature may depend on the size, shape and operating conditions of the operator.

During the defrosting mode a hot gas from the compressor unit may be supplied to the inlet of the evaporator and through refrigerant passages of the evaporator. According to this embodiment, the evaporator is heated by means of the hot gas from the compressor unit. The hot gas from the compressor may be led backwards through the system to the evaporator, e.g. by appropriately switching one or more valves. The cooling process thereby stops, and the system is operated in a 'reversed mode', in the sense that the refrigerant flow in the system is reversed. A temperature of the hot gas may vary depending on ambient conditions and conditions of the vapour compression system. Typically, the hot gas temperature is significantly higher that the melting temperature of ice. The hot gas temperature may be at least 10° C., such as at least 20° C., and such as at least 30° C. Additionally, the hot gas temperature may not be higher than 50° C. If the hot gas is too hot then a humid cloud may form from melted ice. This humid cloud may then stay near the evaporator what is undesired, as melted ice is preferably kept in liquid phase when melted. Water formed from melted ice may flow and run out of the evaporator through a drain pipe. If the humid cloud is formed and it stays around the evaporator, once defrosting is finished, moisture from the humid cloud may deposit on the evaporator again and deteriorate performance of the evaporator in the same manner as ice.

As an alternative, the evaporator may be heated in any other suitable manner, such as by means of an electric heating element or the like.

The hot gas may gradually heat the evaporator from the top to the bottom, i.e., the hot gas may enter in the top tubes of the evaporator and flow gradually to the bottom of the evaporator while heating the evaporator and melting ice buildups. The hot gas may enter the evaporator in its top as an inlet feed pipe is typically arranged at the top of the evaporator for safety reasons, or to remove a risk of liquid hammering. The hot gas inlet may be an outlet when the system is in a cooling mode. Alternatively, the hot gas may gradually heat the evaporator from the bottom to the top, i.e., the hot gas may enter from the bottom tubes of the evaporator and flow gradually towards the top of the evaporator while heating the evaporator and melting ice buildups.

Air in the evaporator and the air surrounding the evaporator may be heated by means of convection. Convection may happen naturally due to differences in temperature between air inside the evaporator and the surface of the evaporator. In one example, convection may happen due to differences in temperature of the tubes and the air surrounding them and the air surrounding the evaporator. Convection may be initiated as soon as the surface of the evaporator itself and the tubes of the evaporator are heated. The air may flow into the direction where a fan of the evaporator is and towards an opening on the inlet side of the evaporator. During defrosting, the fan of the evaporator may be turned off, and therefore it may not interfere with the defrosting process and a heat circulation.

In one embodiment of the invention, the evaporator may be in a flooded state. According to this embodiment, liquid refrigerant is present throughout the entire length of the evaporator, and liquid refrigerant may be allowed to leave the evaporator. In order to prevent liquid refrigerant from reaching the compressor unit, a receiver may be arranged in the refrigerant path between the evaporator and the compressor unit. The receiver may then separate the refrigerant into a gaseous part and a liquid part, and the gaseous part may be supplied to the compressor unit. However, when liquid refrigerant is present throughout the entire length of the evaporator it is ensured that the potential cooling capacity of the evaporator is utilised to a maximum extent. Therefore, the most of the heat generated by the evaporator may be used for evaporation. In industrial applications, such as big cooling houses, flooded evaporators may, thus, be used in order to maximize the cooling capacity.

In one embodiment of the invention, the method may further comprise the steps of:

monitoring, by at least two additional temperature sensors, an evaporator inlet temperature, $T_{e,in}$, at a hot gas inlet of the evaporator and an evaporator outlet temperature, $T_{e,out}$, at a hot gas outlet of the evaporator, monitoring a rate of change of a difference between $T_{e,in}$ and $T_{e,out}$, and terminating defrosting when the rate of change of the difference between $T_{e,in}$ and $T_{e,out}$ approaches zero.

During defrosting, at least two additional temperature sensors may monitor temperatures at the evaporator inlet, $T_{e,in}$, where the hot gas enters the evaporator and at an evaporator outlet, $T_{e,out}$, where the hot gas leaves the evaporator. Similar to the monitoring of the temperature, $T_{air}$, the at least two additional temperatures may be monitored from the beginning of the defrosting mode. Alternatively, additional monitoring of the temperatures may start after a certain period of time upon the initiation of the defrosting mode, as in the initial phase of defrosting no ice will be melted, but energy may rather be spent on heating the evaporator itself. Preferably, the temperatures may be monitored only after several minutes, once the evaporator and its tubes are heated. The temperatures may be continuously monitored over time during defrosting. Alternatively, the temperatures may be measured intermittently, with a certain frequency. The temperature sensors may be placed on one or more of the evaporator tubes. In this way, the temperature of the surface near the hot gas inlet of the evaporator is measured as well as the surface near the hot gas outlet of the evaporator. The measured temperatures may be communicated to a control unit or a processor.

A difference between $T_{e,in}$ and $T_{e,out}$ and a rate of change of a difference between $T_{e,in}$ and $T_{e,out}$ may be monitored, e.g. by means of the control unit or processor mentioned above. Typically, at the beginning of defrosting, the temperatures at the inlet and at the outlet, respectively, will exhibit substantially identical dynamical behaviour. Then, the temperature at the evaporator inlet may begin to rise faster than the temperature at the evaporator outlet. This is expected, as the hot air may melt frost and ice at the areas closer to the hot gas inlet first. Depending on the amount of frost or ice, a time period during which the temperatures at the inlet and outlet of the evaporator are different and rise in different manner may vary.

As frost and ice is melting from the evaporator, temperatures at the inlet and outlet of the evaporator may stabilize and reach constant values. When both temperatures have the constant values, their difference will become constant and therefore the rate of change of the difference will be zero. When the rate of change of the difference between $T_{e,in}$ and $T_{e,out}$ approaches zero the evaporator operates in a manner which is expected when there is no ice or frost on its surface. Therefore, no change in the difference between the two temperatures indicates that all the ice or frost has been removed and there is no need for further defrosting. The processor may analyse the rate of change of the difference over time. If the rate of change of the difference is zero for a certain period of time, information from the processor may be communicated to another control unit in order to stop defrosting. In this manner, defrosting is terminated as soon as all frost or ice is removed from the evaporator.

Monitoring the two additional temperatures may serve as a backup measurement for the defrost termination.

Similarly to the defrost termination when monitoring the at least one temperature, $T_{air}$, the step of terminating defrosting may be performed when the rate of change of the difference between $T_{e,in}$ and $T_{e,out}$ has been smaller than a predetermined threshold value for the predetermined time. During defrosting and for a short period of time, it may happen that both temperatures of the inlet and outlet of the evaporator change in the same manner. The rate of change between $T_{e,in}$ and $T_{e,out}$ during this short period of time may be close to zero. This situation may arise, e.g., when the evaporator reaches the freezing point of water, and due to the ice buildups, temperatures $T_{e,in}$ and $T_{e,out}$ may both be close to the freezing point of water and keep the same value for a short period of time. To avoid a premature termination of defrosting, the rate of change may be smaller than the predetermined threshold value for a predetermined period of time. The predetermined time may be longer than one minute. The predetermined threshold value may be such as between 0° C./s and 5° C./s, such as between 0° C./s and 4° C./s, such as between 0° C./s and 3° C./s, such as between 0° C./s and 2° C./s, and such as between 0° C./s and 1° C./s around zero, and such as approximately 1° C./s, such as approximately 2° C./s, such as approximately 3° C./s, such as approximately 4° C./s, and such as approximately 5° C./s.

In yet another embodiment of the invention, the step of monitoring at least one temperature, $T_{air}$, may comprise monitoring a first air temperature, $T_{air,in}$, at an air inlet of the evaporator and a second air temperature, $T_{air,out}$, at an air outlet of the evaporator. An additional temperature sensor measuring a second air temperature may be used as a backup to the temperature sensor measuring the first air temperature at the air inlet and vice versa.

BRIEF DESCRIPTION OF THE DRAWINGS

The invention will now be described in further detail with reference to the accompanying drawings in which.

DETAILED DESCRIPTION

Figure 1:
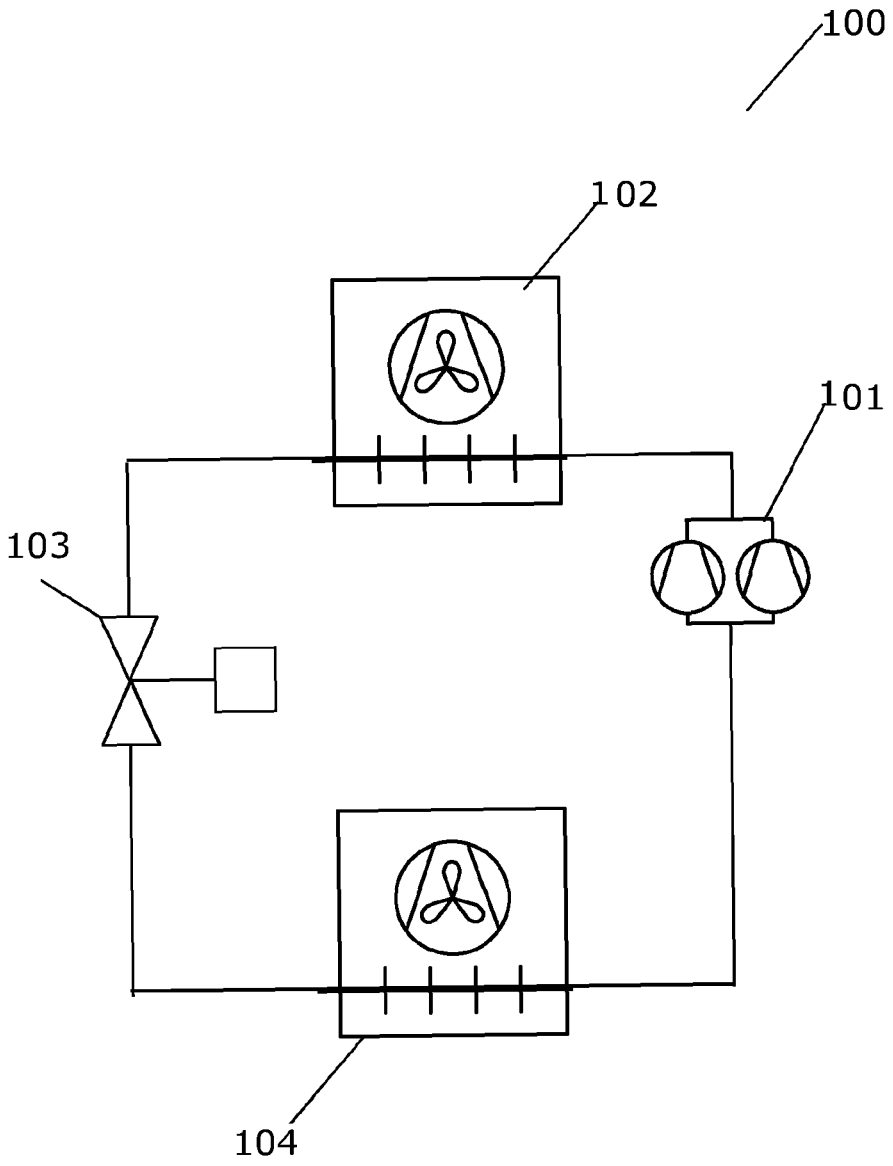
FIG. 1 shows a simplified diagram of a vapour compression system.

FIG. 1 shows a simplified diagram of a vapour compression system 100 comprising a compressor unit 101, a heat rejecting heat exchanger 102, an expansion device 103 and an evaporator 104. The compressor unit 101 shown in FIG. 1 comprises two compressors. It is noted that it is within the scope of the present invention that the compressor unit 101 comprises only one compressor, e.g. a variable capacity compressor, or that the compressor unit 101 comprises three or more compressors. Refrigerant flowing through the system 100 is compressed by the compressor unit 101 before being supplied to the heat rejecting heat exchanger 102. In the heat rejecting heat exchanger 102, heat exchange takes place with a secondary fluid flow across the heat rejecting heat exchanger 102 in such a manner that heat is rejected from the refrigerant. In the case that the heat rejecting heat exchanger 102 is in the form of a condenser, the refrigerant passing through the heat rejecting heat exchanger 102 is at least partly condensed. In the case that the heat rejecting heat exchanger 102 is in the form of a gas cooler, the refrigerant passing through the heat rejecting heat exchanger 102 is cooled, but it remains in a gaseous state.

The refrigerant leaving the heat rejecting heat exchanger 102 is then passed through the expansion device 103 which may, e.g., be in the form of an expansion valve. The refrigerant passing through the expansion device 103 undergoes expansion and is further supplied to the evaporator 104. In the evaporator 104, heat exchange takes place with a secondary fluid flow across the evaporator 104 in such a manner that heat is absorbed by the refrigerant, while the refrigerant is at least partly evaporated. The refrigerant leaving the evaporator 104 is then supplied to the compressor unit 101.

Figure 2:
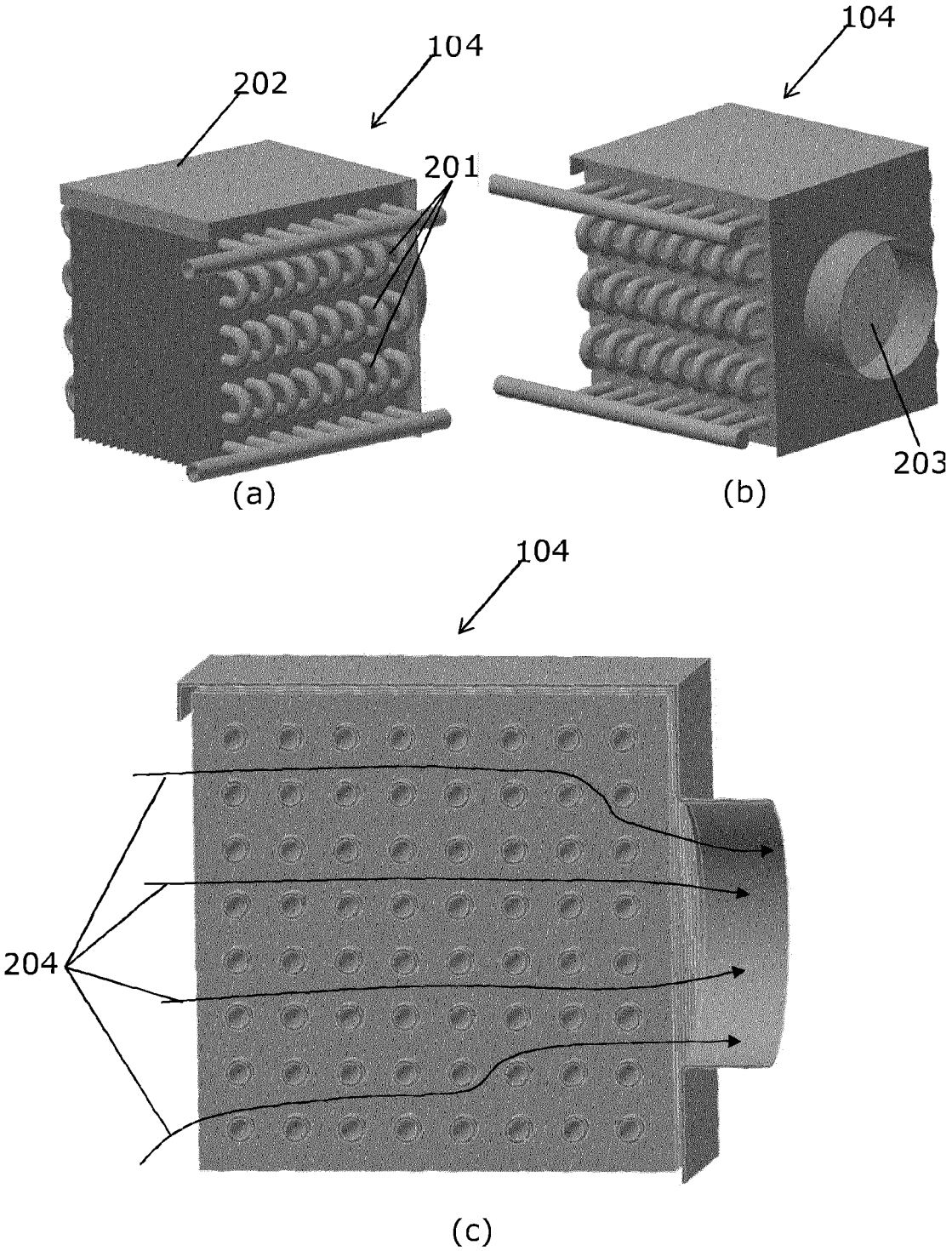
FIG. 2 shows a perspective view of an evaporator (a), (b) and an air flow through the evaporator in a cooling mode (c)

FIGS. 2(*a*) and 2(*b*) show perspective views of a generic model of an evaporator 104. In the evaporator 104 the liquid refrigerant is evaporated into a gaseous form/vapour. The evaporator 104 of FIG. 2 comprises a plurality of tubes 201 which guide the liquid refrigerant there through and which are enclosed in an evaporator structural support 202. The tubes 201 may typically be arranged in a horizontal manner. The length of the tubes 201 may vary and that length may define one dimension of the evaporator 104. The evaporator 104 comprises a fan 203 which drives a secondary air flow across the evaporator 104 and over the evaporator tubes 201 as indicated by arrows 204 in FIG. 2(*c*). In case of a refrigeration system, the liquid refrigerant absorbs heat from the air passing through the evaporator 104, thereby reducing the temperature of the air and providing cooling for a closed volume being in contact with the evaporator 104. The closed volume may, e.g., be a refrigeration chamber.

Figure 3:
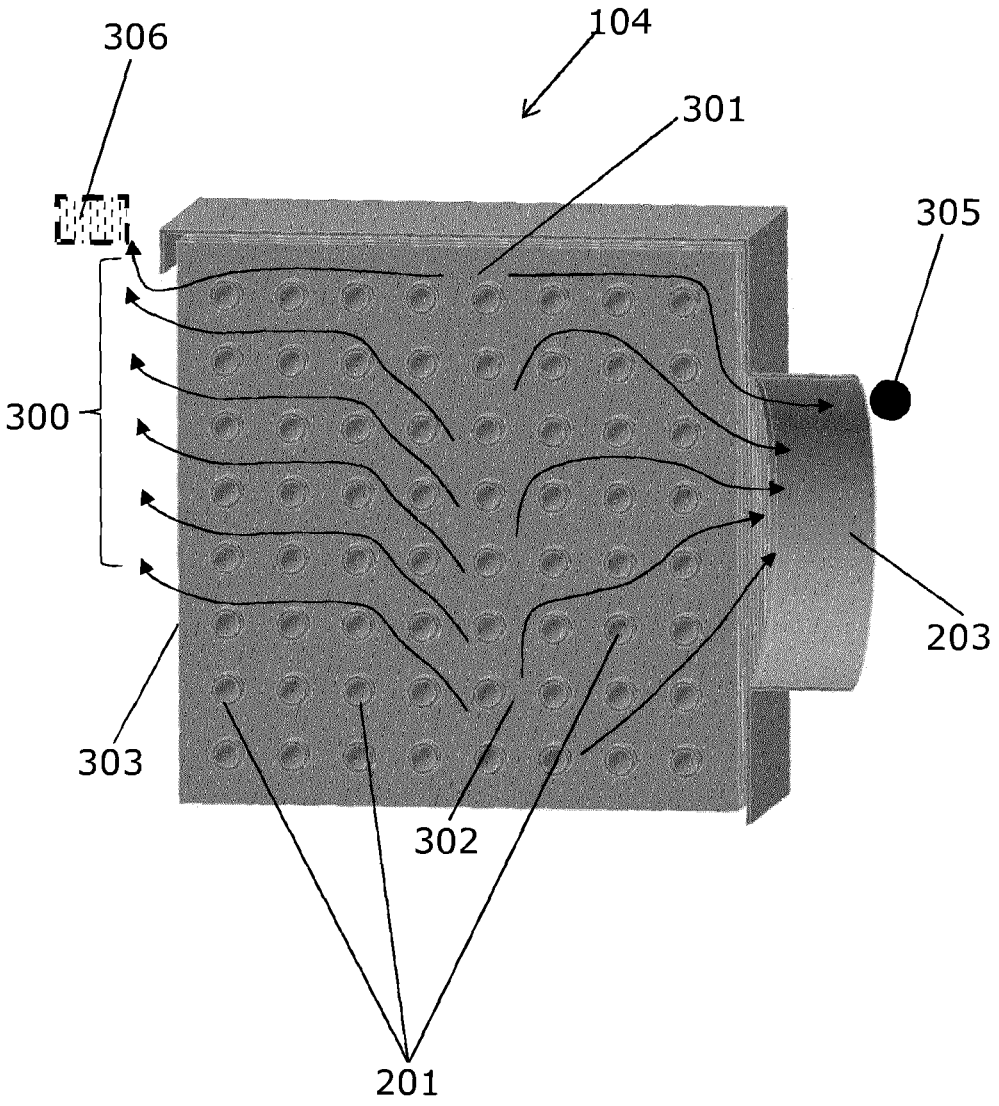
FIG. 3 shows an evaporator operating in a defrosting mode.

FIG. 3 shows a cross section of the evaporator 104 operating in a defrosting mode. During the defrosting mode, the fan 203 is turned off. In the defrosting mode, the tubes 201 may be heated from inside by a hot gas. When defrosting with the hot gas, the evaporator 104 is heated from the top part 301 and as the hot gas flows through the tubes 201 all of the metal of the evaporator 104 is gradually heated. The hot gas will gradually flow towards the bottom part 302 of the evaporator 104. Because of the mass and gradual cooling/condensing of the hot gas, the top 301 and bottom 302 of the evaporator are heated with a delay. The hot gas heats up the tubes 201, heats and melts ice accumulated on the tubes 201 and fins (not shown). While the entire evaporator 104 is heating, convection to the surrounding air is happening, i.e., the volume of air between the fins and tubes 201 is also heating. The volume of air will start natural movement, as indicated by arrows 300, due to differences in temperature. The volume of air moves into the direction of the fan 203 and towards openings on the air inlet side 303 of the evaporator 104.

During defrosting, at least one temperature sensor 305 monitors a temperature of air leaving the evaporator 104. Alternatively, the sensor 305 may be positioned at the air inlet 303 of the evaporator 104, as indicated by a dashed line box 306. When measuring the air temperature by either the sensor 305 or 306 close to the inlet or outlet of the evaporator 104, the transient behaviour of the air temperature inside the evaporator can be recorded.

Figure 4:
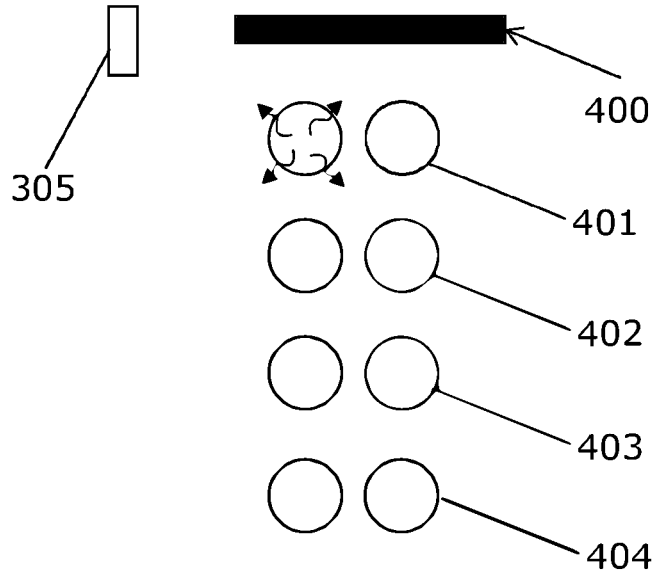
FIG. 4 shows diagrams of surface temperature changes over time of a simple evaporator with four rows of tubes when there is no ice buildup thereon.
Figure 4:
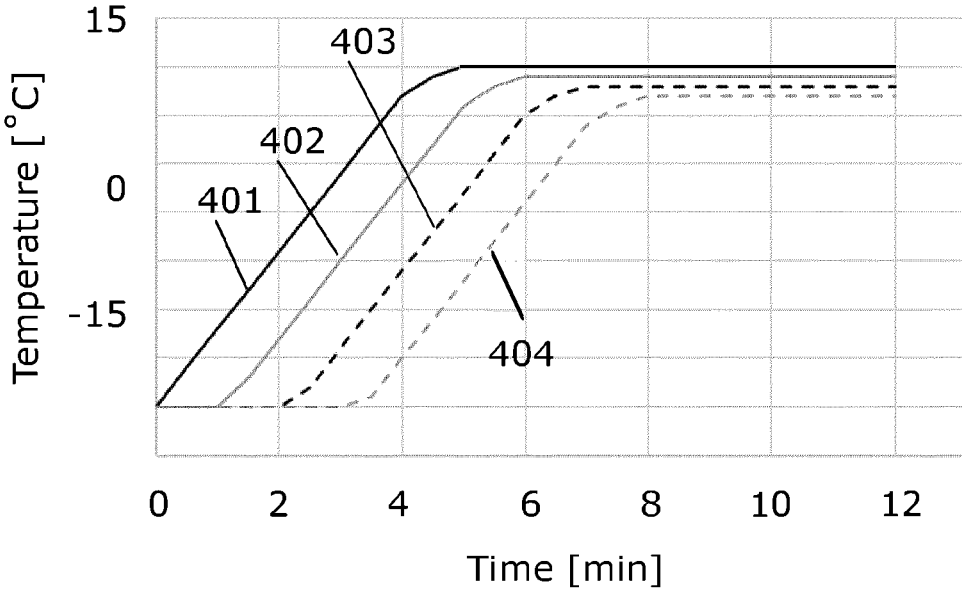
Figure 4:
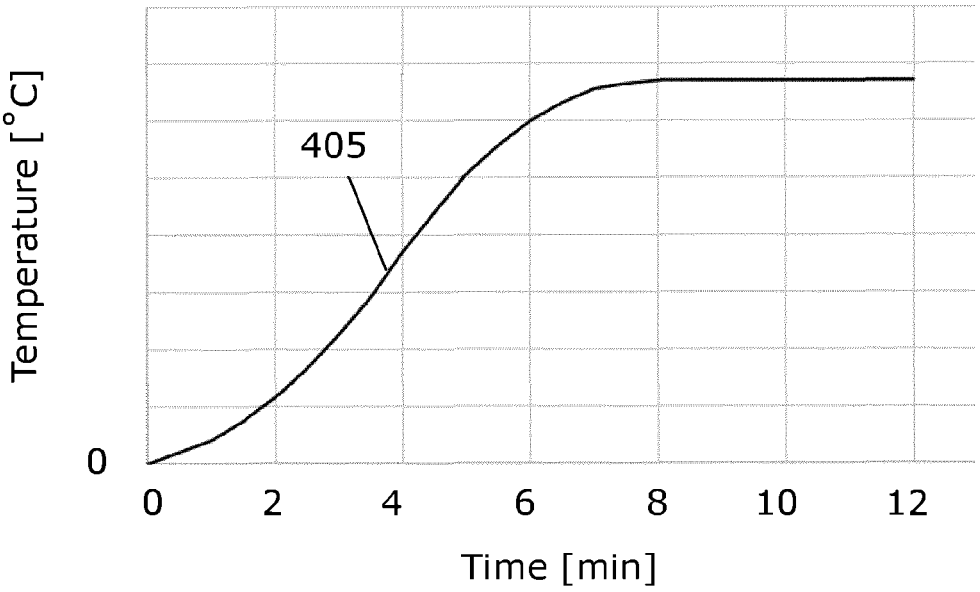

FIG. 4(*a*) shows a simplified model of an evaporator 400 having only four rows of tubes 401-404. The sensor 305 is monitoring the temperature of air leaving the evaporator 400. On this simple evaporator 400 with four rows, the convective heat transfer, Q, to the surrounding air can be expressed as $Q=hA\Delta T$, where h is a heat transfer coefficient [$W/(Km^2)$], A is the evaporator area [$m^2$], and $\Delta T$ is $T_{air}-T_e$, $T_e$ is the evaporation temperature. Assuming the same size and constant temperature of the surrounding air, then the total convective heat transfer can be expressed as $\Sigma Q=hA\Sigma(\Delta T)$. The tubes 401-404 are typically heated with the hot gas one after another, i.e., with a short time delay, as represented in FIG. 4(*b*). The graphs in FIG. 4(*b*) show surface temperature for each of four tubes 401-404 of the evaporator 400 when there is no ice on the evaporator 400 and its tubes 401-404. The tubes 401-404 are slowly heated up and after a certain time their temperature reaches a constant value. That is when a steady state starts for each of the tubes 401-404. The accumulated temperature difference $\Sigma(\Delta T)$ is represented by curve 405 in FIG. 4(*c*), again, in the case when there is no ice nor frost accumulated on the evaporator 400. The accumulated temperature difference $\Sigma(\Delta T)$ of the surface temperatures of the tubes 401-404 reflects the heating of the surrounding air temperature inside the evaporator 400. The same temperature trend is then monitored by the sensor 305. In the first 8 minutes the evaporator 400 itself is heated and the air temperature measured by the sensor 305 is constantly rising. Once the evaporator 400 is heated, stable convection happens and air temperature at the outlet of the evaporator 400 reaches a constant value. That is when the rate of change of the air temperature approaches zero and when defrosting can be terminated.

Figure 5:
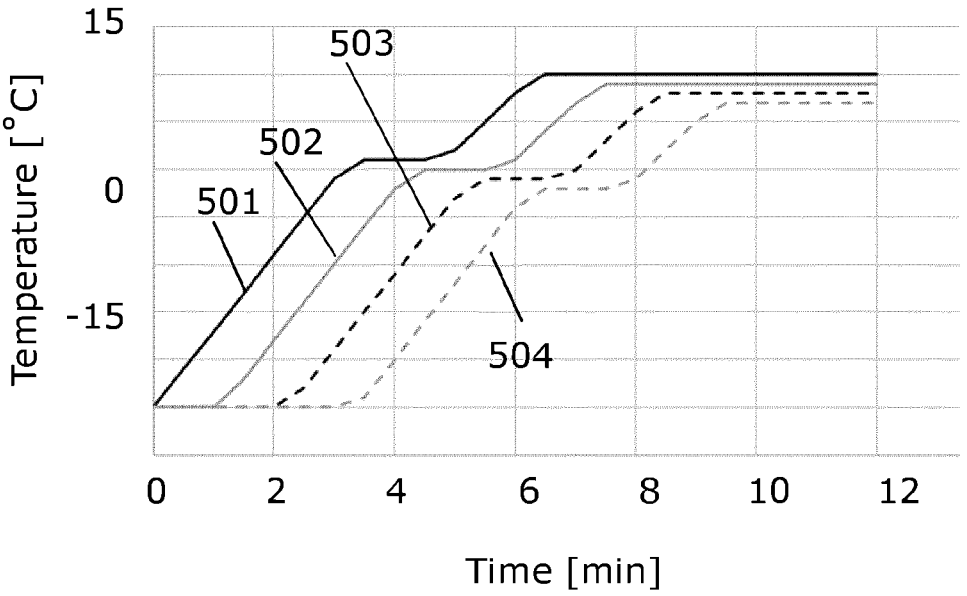
FIG. 5 shows diagrams of surface temperature changes over time of a simple evaporator with four rows of tubes when there is ice buildup on the tube.
Figure 5:
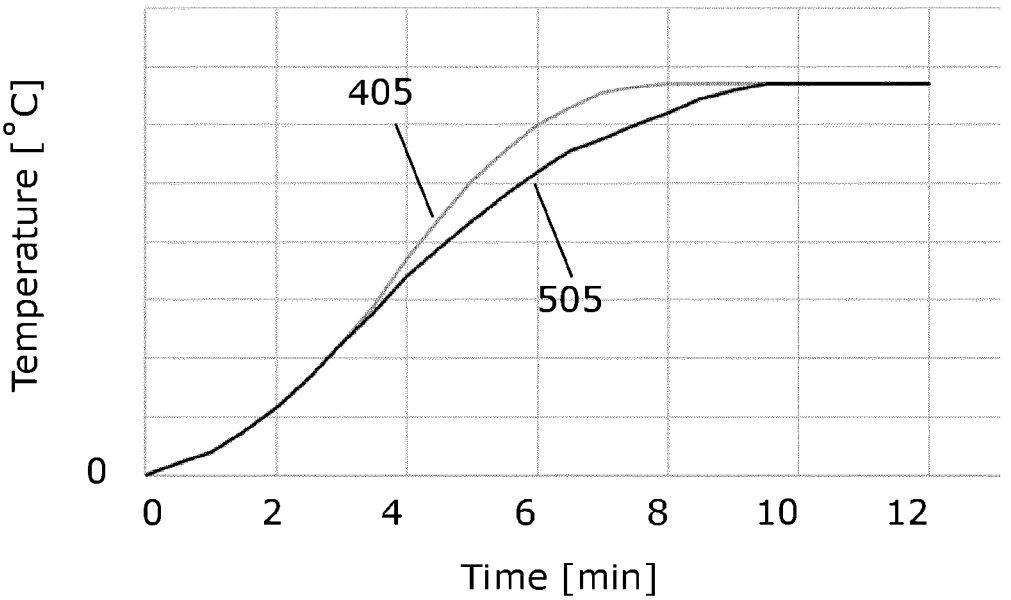

FIG. 5(*a*) shows diagrams 501-504 of surface temperature changes over time of the same simple evaporator 400 with four rows of tubes in case when there is frost or ice buildup on the tubes 401-404. Curve 501 corresponds to the tube 401, as the first row 401 of tubes is heated first. The effect of ice melting results in a different temperature profile compared to one shown in FIG. 4(*b*). The temperature change in this case is similar to the case when there is no ice in the first several minutes as, at first, it is only the evaporator itself which is heating up. When the surface temperature of the tubes reaches zero, ice starts melting and the surface temperature maintains the same temperature for a short period of time, as shown by all the curves 501-504. In this short period of time, the rate of change of the surface temperature of the tube approaches zero. This short period of time is one of the reasons why the step of terminating defrosting may be performed when the rate of change of air temperature is smaller than a predetermined threshold for a predetermined time. When ice starts melting the surface temperature of the tubes will rise again and reach a steady state later compared to the case when there is no ice. This difference may be seen in FIG. 5(*b*) where both cases are shown, curve 405 represents air temperature change when there is no ice, and curve 505 represents air temperature change when there is ice on the evaporator 400. It can be seen that the steady state is reached more than 2 minutes later than in the case when there is no ice on the evaporator 400. As stated above, the surrounding air temperature inside the evaporator 400 will be heated as the profile of the accumulated temperature difference. When measuring the temperature with the sensor 305, a similar profile is seen.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for terminating defrosting of an evaporator, the evaporator being part of a vapour compression system, the vapour compression system further comprising a compressor unit, a heat rejecting heat exchanger, and an expansion device, the compressor unit, the heat rejecting heat exchanger, the expansion device and the evaporator being arranged in a refrigerant path, and an air flow flowing across the evaporator, the method comprising the steps of:

operating the vapour compression system in a defrosting mode, monitoring, by at least one temperature sensor, at least one temperature, $T_{air}$, of air leaving the evaporator, monitoring a rate of change of the temperature, $T_{air}$, and terminating defrosting when the rate of change of the temperature, $T_{air}$, approaches zero.

2. The method according to claim 1, wherein the step of terminating defrosting is performed when the rate of change of the temperature, $T_{air}$, has been smaller than a predetermined threshold value for a predetermined time.

3. The method according to claim 1, wherein during the defrosting mode a hot gas from the compressor unit is supplied to refrigerant passages of the evaporator.

4. The method according to claim 3, wherein the hot gas heats the evaporator from the top to the bottom.

5. The method according to claim 3, wherein air in the evaporator and the air surrounding the evaporator are heated by means of convection.

6. The method according to claim 3, wherein the hot gas heats the evaporator from the bottom to the top.

7. The method according to claim 1, wherein the evaporator is in a flooded state.

8. The method according to claim 1, wherein the method further comprises the steps of:

monitoring, by at least two additional temperature sensors, an evaporator inlet temperature, $T_{e,in}$, at a hot gas inlet of the evaporator and an evaporator outlet temperature, $T_{e,out}$, at a hot gas outlet of the evaporator, monitoring a rate of change of a difference between $T_{e,in}$ and $T_{e,out}$, and terminating defrosting when the rate of change of the difference between $T_{e,in}$ and $T_{e,out}$ approaches zero.

9. The method according to claim 8, wherein the step of terminating defrosting is performed when the rate of change of the difference between $T_{e,in}$ and $T_{e,out}$ has been smaller than a predetermined threshold value for the predetermined time.

10. The method according to claim 1, wherein the step of monitoring at least one temperature, $T_{air}$, comprises monitoring a first air temperature, $T_{air,in}$, at an air inlet of the evaporator and a second air temperature, $T_{air,out}$, at an air outlet of the evaporator.

11. The method according to claim 2, wherein during the defrosting mode a hot gas from the compressor unit is supplied to refrigerant passages of the evaporator.

12. The method according to claim 4, wherein air in the evaporator and the air surrounding the evaporator are heated by means of convection.

13. The method according to claim 4, wherein the hot gas heats the evaporator from the bottom to the top.

14. The method according to claim 5, wherein the hot gas heats the evaporator from the bottom to the top.

15. The method according to claim 2, wherein the evaporator is in a flooded state.

16. The method according to claim 3, wherein the evaporator is in a flooded state.

17. The method according to claim 4, wherein the evaporator is in a flooded state.

18. The method according to claim 5, wherein the evaporator is in a flooded state.

19. The method according to claim 6, wherein the evaporator is in a flooded state.

20. The method according to claim 2, wherein the method further comprises the steps of:

monitoring, by at least two additional temperature sensors, an evaporator inlet temperature, $T_{e,in}$, at a hot gas inlet of the evaporator and an evaporator outlet temperature, $T_{e,out}$, at a hot gas outlet of the evaporator, monitoring a rate of change of a difference between $T_{e,in}$ and $T_{e,out}$, and terminating defrosting when the rate of change of the difference between $T_{e,in}$ and $T_{e,out}$ approaches zero.

* * * * *